US011814907B2

(12) United States Patent
Brooks et al.

(10) Patent No.: US 11,814,907 B2
(45) Date of Patent: Nov. 14, 2023

(54) DRILL COUPLER FOR MITIGATING TORSIONAL VIBRATION

(71) Applicant: Ulterra Drilling Technologies, L.P., Fort Worth, TX (US)

(72) Inventors: Nathan Andrew Brooks, Slade Point (AU); Jason C. Maw, Beaumont (CA); Matthew Roseman, Fort Worth, TX (US); Thomas A. Damian, Dallas, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 17/097,333

(22) Filed: Nov. 13, 2020

(65) Prior Publication Data

US 2021/0348452 A1 Nov. 11, 2021

Related U.S. Application Data

(60) Provisional application No. 63/020,406, filed on May 5, 2020.

(51) Int. Cl.

| | |
|---|---|
| ***E21B 17/04*** | (2006.01) |
| ***E21B 17/05*** | (2006.01) |
| ***E21B 10/20*** | (2006.01) |

(52) U.S. Cl.

CPC ..... *E21B 17/05* (2013.01); *E21B 10/20* (2013.01)

(58) Field of Classification Search

CPC ..... E21B 17/076; E21B 17/03; E21B 17/04

See application file for complete search history.

(56) References Cited

U.S. PATENT DOCUMENTS 170,563 A * 11/1875 Hoffman ..... E21B 33/1216 277/337
1,605,186 A * 11/1926 Hite ..... E21B 19/02 74/582
2,072,430 A * 3/1937 Roco ..... E21B 21/10 166/158

(Continued)

FOREIGN PATENT DOCUMENTS

NO 343669 5/2019

OTHER PUBLICATIONS

International Application No. PCT/US2021/029129 , International Search Report and Written Opinion, dated Jun. 15, 2021, 10 pages.

(Continued)

*Primary Examiner* — Kipp C Wallace

(74) *Attorney, Agent, or Firm* — Kilpatrick Townsend & Stockton LLP

(57) ABSTRACT

The present disclosure relates to coupler for connecting a drill pipe to a drill bit as well as methods for manufacturing the same. In particular, the present disclosure describes a coupler which includes a housing including a first connecting portion at a first end for connecting to a drill pipe, a base coupled to the housing and including a second connecting portion at a second end for connecting to a drill bit, and an intermediate component disposed between the base and the housing, wherein the coupler is configured for rotation about an axis during use, with the intermediate component allowing limited relative rotation between the housing and the base about the axis.

22 Claims, 6 Drawing Sheets

(56) References Cited

U.S. PATENT DOCUMENTS

| | | | | | |
|---|---|---|---|---|---|
| 2,216,361 | A * | 10/1940 | Twiss | E21B 17/04 | 279/99 |
| 2,740,651 | A * | 4/1956 | Ortloff | E21B 17/07 | 403/300 |
| 2,942,851 | A * | 6/1960 | Beck | E21B 17/04 | 175/107 |
| 5,224,898 | A * | 7/1993 | Johnson | E21B 17/073 | 464/83 |
| 5,947,214 | A * | 9/1999 | Tibbitts | E21B 44/04 | 175/276 |
| 6,098,726 | A * | 8/2000 | Taylor | E21B 17/076 | 175/320 |
| 6,808,455 | B1 * | 10/2004 | Solorenko | F16F 15/124 | 464/83 |
| 6,945,338 | B1 * | 9/2005 | Defourny | E21B 10/00 | 175/106 |
| 9,863,191 | B1 * | 1/2018 | Ide | E21B 4/003 | |
| 2011/0186284 | A1 * | 8/2011 | Jekielek | E21B 47/017 | 166/65.1 |
| 2014/0102804 | A1 | 4/2014 | Cote | | |
| 2016/0201409 | A1 * | 7/2016 | Gylling | E21B 7/20 | 166/378 |
| 2018/0058148 | A1 * | 3/2018 | Zhang | E21B 10/62 | |
| 2018/0340414 | A1 * | 11/2018 | Derkacz | E21B 47/18 | |

OTHER PUBLICATIONS

International Application No. PCT/US2021/029129, International Preliminary Report on Patentability, dated Nov. 17, 2022, 7 pages.
Australian Application No. AU2021268568, "First Examination Report", dated Jun. 23, 2023, 3 pages.

* cited by examiner

DRILL COUPLER FOR MITIGATING TORSIONAL VIBRATION

PRIORITY

This application claims priority to U.S. Provisional Application No. 63/020,406, filed on May 5, 2020, which is incorporated herein by reference.

FIELD

The present disclosure generally relates to a coupler for connecting components of a drill string, a drill assembly including such a coupler, and a method of manufacturing such a coupler. The coupler of the present disclosure advantageously transmits torques while dampening system vibrations and accommodating (e.g., limiting, reducing, or preventing) misalignment.

BACKGROUND

A range of drilling techniques are known for forming holes in the ground, passing through rock or the like. Each technique tends to be suited to a particular application or type of substrate, and each technique may also have specialised equipment, particularly in relation to the drill bit.

Drilling techniques used for oil and gas wells often involve a drill string comprised of numerous interconnected components. For example, the drill string generally includes a drill bit connected to a drill pipe, where the drill bit is advanced into the ground by rotating the drill pipe so that the drill bit cuts into the rock. Various forms of drill bits are known for this purpose, including fixed-cutter bits and roller-cone bits. Within these categories of drill bits there are also significant variation in design, depending on factors such as the hardness, type, and structure of the ground that is being drilled.

In contrast, drilling boreholes in overburden (e.g., in a blasthole pattern), for example, will require different techniques and equipment. Different types of drill bits may be required to withstand the significant and constant variation in rock type and hardness, as there may be a mixture of different types or rocks and soil, or various unpredictable cracks and discontinuities that would damage the types of equipment described above. Additionally, rather than pure rotation, the drilling may use rotation and hammering, or percussion, to advance the drill bit into the ground.

These alternative techniques and equipment may require various trade-offs, however. The different equipment design may be more complex or the drill bits used may not be capable of advancing through the ground as quickly due to the changes in design required to enable them to withstand the harsher drilling environment.

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

SUMMARY

In one aspect, the present disclosure provides a coupler for connecting a first drill string component to a second drill string component, the coupler comprising: a housing comprising a first connecting portion at a first end for connecting to a first drill string component; a base coupled to the housing and comprising a second connecting portion at a second end for connecting to a second drill string component; and an intermediate component disposed between the base and the housing; wherein the coupler is configured for rotation about an axis during use, and wherein the intermediate component is configured for allowing limited relative rotation between the housing and the base about the axis. In some cases, the first drill string component is selected from the group consisting of a drill bit, a drill collar, a drill pipe segment, a stabilizer, a mud motor, a component of a mud motor assembly, and a bottom hole assembly. In some cases, the second drill string component is selected from the group consisting of a drill bit, a drill collar, a drill pipe segment, a stabilizer, a mud motor, a component of a mud motor assembly, and a bottom hole assembly. In some cases, the first drill string component comprises a mud motor, a drill collar, rotatory steerable tool, or a metal tubular component, and wherein the second drill string component comprises a drill bit In some cases, the intermediate component is made from a resiliently deformable material. In some cases, the first drill string is connected to the housing by a thread or by welding, or wherein the first drill string component is contiguous with the housing. In some cases, the second drill string component is connected to the base by a thread or by welding, or wherein the second drill string component is contiguous with the base. In some cases, the coupler comprises a central bore for fluid communication between the first drill string component and the second drill string component through the coupler. In some cases, the relative rotation between the housing and the base is limited to less than 30° from a nominal position. In some cases, the intermediate component has a maximum nominal thickness of less than 30 mm. In some cases, the base is situated at least partially inside the housing and the intermediate component is a sleeve that fits between the base and the housing and is substantially inside the housing.

In some cases, the base comprises: an elongate cylinder with a flange extending from a lower end normal to the axis, the flange being configured for attachment to the second drill string component; and a plurality of splines extending radially from an outer surface of the elongate cylinder. In some cases, the housing comprises a cylindrical body with a plurality of grooves on an inner surface configured to accommodate the splines of the base. In some cases, the intermediate component is a sleeve that fills a space between the splines of the base and the grooves of the housing. In some cases, the elongate cylinder of the base fits substantially inside the housing and a locking ring is secured to an end of the elongate cylinder opposite to the flange, such that the locking ring prevents removal of the base from the housing. In some cases, the flange comprises one or more through holes and the intermediate component is formed by injecting or pouring a settable compound through the one or more through holes.

In another aspect, the present disclosure describes a method of manufacturing a coupler for connecting a first drill string component to a second drill string component, the coupler comprising a housing, a base, and an intermediate component disposed between, the method comprising the steps of: forming the housing and the base; inserting the base at least partially into the housing and securing to one another; and forming the intermediate component by injecting or pouring a settable compound into a space between the housing and the base.

In another aspect, the present disclosure describes a method of manufacturing a coupler for connecting a first drill string component to a second drill string component, the coupler comprising a housing, a base, and an intermediate component disposed between, the method comprising the steps of: forming the housing, the base, and the intermediate component; inserting the base at least partially into the housing with the intermediate component disposed between; and securing the base and the housing to one another.

In another aspects, the present disclosure describes a method of drilling, the method comprising the steps of: securing a drill bit to a drill string component using a coupler according to claim 1 to form an assembled drill; and using the assembled drill string with a drill rig to drill. In some cases, the drill bit is a polycrystalline diamond compact (PDC) bit or a claw bit.

It will be appreciated that the broad forms of the embodiments and their respective features can be used in conjunction and/or independently, and reference to separate broad forms is not intended to be limiting. Furthermore, it will be appreciated that features of the method can be performed using the system or apparatus and that features of the system or apparatus can be implemented using the method.

BRIEF DESCRIPTION OF THE DRAWINGS

Various examples and embodiments of the present disclosure will now be described with reference to the accompanying drawings, in which.

DETAILED DESCRIPTION

Figure 1:
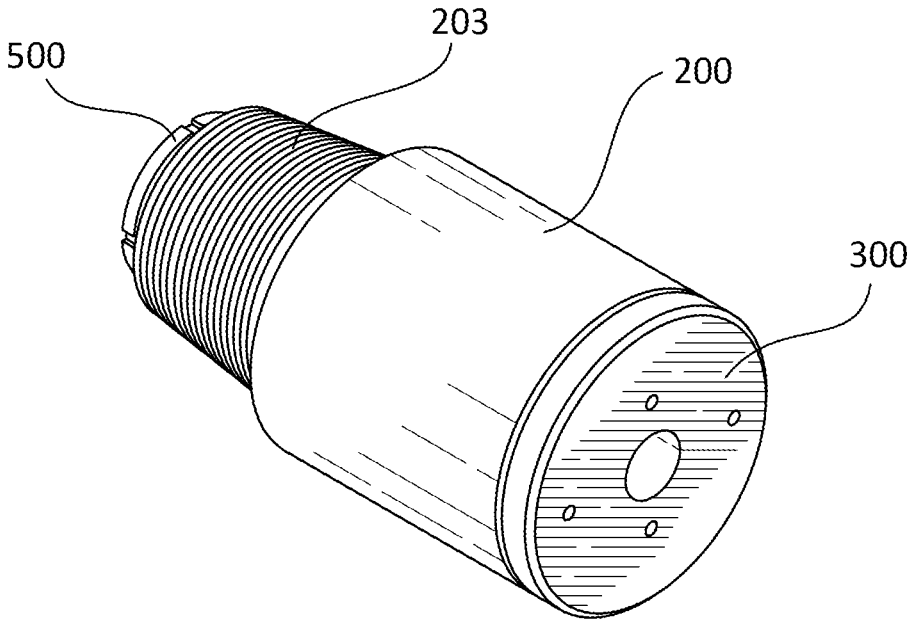
FIG. 1 is a lower angled isometric view of a drill coupler according to an embodiment of the present disclosure.

An example embodiment of a coupler generally suitable for connecting components of a drill string according to an embodiment will now be described.

The term "drill string" as used throughout the specification is to be broadly interpreted to encompass any column, piping, or machinery that transmits drilling fluid and/or torque for downhole drilling. The drill string comprises a number of components, including, for example, a drill bit, a drill collar, one or more segments of drill pipe (e.g., transition pipe and/or heavyweight drill pipe), drilling stabilizers, a downhole motor (e.g., a mud motor and/or a mud motor assembly), and other bottom hole assembly components. In general, the bottom hole assembly may be any component or tool at the lower portion of the drill string, such as a rotary steerable system, measurement while drilling tools, and/or logging while drilling tools).

The drill pipe may be any pipe, rod, or other similar component, or any string or series of such components, which are used or can be used in a drilling process. The drilling process could include any of a wide range of drilling applications, such as but not limited to exploration drilling, oil and gas well bore drilling, blast hole drilling, and various other types of rock or earth drilling.

The drill bit may be chosen from a broad range of devices. For example, it may be any known or new drill bit to be used in any of the drilling processes mentioned above or other drilling processes. Examples may include, but are not limited to, various types of rolling cutter bits, fixed cutter bits, polycrystalline diamond compact (PDC) bit, and claw bits.

As noted, the present disclosure describes a coupler, a drill string component for connecting components of a drill string. The coupler is generally suitable for connecting any components of the drill string. In one embodiment, for example, the coupler connects the drill bit and a segment of drill pipe. Those of skill in the art will appreciate that, although the embodiment detailed herein primarily describes connecting the drill bit to the drill pipe, the connectors described herein are suitable for connecting and transmitting torque between other components of the drill string.

The coupler includes a housing, a base and an intermediate component. The housing has a first component (e.g., pipe) connecting portion at a first (e.g., upper) end for connecting to the drill pipe or other drill string component. This connecting portion may use any suitable method for connecting to the drill string component, such as welding, a locking mechanism or a threaded connection, where the housing could have either a male or a female thread of any suitable type.

The base is coupled to the housing and has a second component (e.g., drill bit) connecting portion at a second (e.g., lower) end for connecting to the drill bit. This connecting portion may use any suitable method for connecting to the drill bit, such as welding, a locking mechanism or a threaded connection, where the base could have either a male or a female thread of any suitable type.

The intermediate component is disposed between the base and the housing. The coupler is configured for rotation about an axis during use, and the intermediate component allows limited relative rotation between the housing and the base about the axis. In this way, the coupler transmits torque between the housing (e.g., including the first component) and the base (e.g., including the second component).

As noted, the coupler comprises the housing that connects a first component at a first end and the base that connects a second component at a second end. In some embodiments, the first end is an upper end, and the second end is a lower end. Said another way, the housing may be oriented toward the top end of the coupler, and the base may be oriented toward the bottom end of the coupler. In some embodiments, the first end is a lower end, and the second end is an upper end. Said another way, the housing may be oriented toward the bottom end of the coupler, and the base may be oriented toward the top end of the coupler.

The relative rotation between the housing and the base is advantageous as it may allow for sudden high forces to be damped or absorbed, thereby protecting the drill bit, drill pipe and/or other drilling components.

For example, some areas of ground being drilled may be non-uniform, which can result in the drill bit spinning relatively freely for a short time before contacting a harder rock or other feature. This can result in a sudden force on the bit, causing a shock through the drilling equipment and potentially damaging various components, particularly the bit. The drill bit and drill pipe together can have significant mass and therefore momentum, so that when the harder rock is contacted the assembly cannot be easily slowed, thereby creating extreme forces. However, the coupler can allow the drill bit to be temporarily slowed more quickly, helping to dissipate the forces and prevent damage.

Further features of embodiments of the coupler will now be described with regard to the Figures.

In some embodiments, the intermediate component is made from a resiliently deformable material. For example, the intermediate components may be made from a material such as, but not limited to, rubber, high resilience metals such as high carbon spring steel, or plastic. In these embodiments, the intermediate component may be deformed as the base and the housing rotate relative to one another, before the components move back to the original positions and the intermediate component returns to the original shape.

In these or other embodiments, the relative rotation between the housing and the base may be limited. That is, there may be a maximum degree of rotation from a nominal position past which the components cannot move. In one embodiment, for example, the relative rotation between the housing and the base is limited to from 0° to 30°, e.g., from 1° to 28°, from 2° to 26°, from 3° to 24°, from 4° to 22°, or from 5° to 20°. In terms of lower limits, the relative rotation may be limited to greater than 1°, e.g., greater than 2°, greater than 3°, greater than 4°, or greater than 5°. In terms of upper limits, the relative rotation may be limited to less than 30°, less than 28°, less than 26°, less than 24°, less than 22°, or less than 20°.

In some embodiments, the coupler may have a central bore for fluid communication between the drill pipe and the drill bit through the coupler. This allows any required drilling fluid such as air or drilling mud to be pumped down the centre of the drill pipe, through the coupler and into the drill bit where it can exit to carry cuttings back to the surface.

In some embodiments, the base can be situated at least partially inside the housing. The intermediate component may be a sleeve that fits between the base and the housing and is substantially inside the housing. That is, there may be a space between at least part of the base and the housing when assembled, which allows for the intermediate component to be shaped so that it fills this space.

In some particular example embodiments, the base may be formed with an elongate cylinder with a flange extending from a lower end normal to the axis. This flange can be configured for attachment to the drill bit. A plurality of splines may also extend radially from an outer surface of the cylinder. Similarly, in some particular example embodiments the housing may be formed with a cylindrical body with a plurality of grooves on an inner surface. These grooves can be configured to accommodate the splines of the base.

Alternatively, in some embodiments, the housing may be formed with a cylindrical body with a plurality of splines may extend radially from an inner surface, and the outer surface of the cylinder may be formed with a plurality of grooves. These grooves can be configured to accommodate the splines of the base.

Such embodiments may be advantageous because they can interact to limit the rotation of the base relative to the housing, due to the splines interacting with the grooves. The intermediate component may also be formed as a sleeve that fills the space between the splines of the base and the grooves of the housing, thereby dampening the relative rotation prior to a limit being reached and preventing any movement between the base and the housing in the absence of a significant force.

As has been noted, in some embodiments, the intermediate component is formed as a sleeve. The structure of the sleeve is not particularly limited, and the sleeve may or may not comprise numerous, separate subcomponents. In some cases, for example, the intermediate component may be a single, contiguous sleeve. In some cases, the intermediate component may be a sleeve formed from numerous subcomponents, which may, for example, link or otherwise connect or abut to form the intermediate component.

The nominal thickness of the intermediate component is critical to the effective performance of the drill couplers described herein. That is, the intermediate component must be suitably thick to support the necessary function of the drill couplers. In particular, if the intermediate component is too thin, the intermediate component will not adequately dampen vibrations of drill string components. In addition, if the intermediate component is too thin, the intermediate component may be overly susceptible to damage, degradation, deterioration, or failure.

In some embodiments, the intermediate component has a nominal thickness that is substantially consistent. This nominal thickness may be any suitable amount and may vary depending on the size of the coupler and various other factors. In one embodiment, for example, the nominal thickness is from 0.5 mm to 30 mm, e.g., from 1 mm to 25 mm, from 2 mm to 20 mm, or from 5 mm to 15 mm. In terms of upper limits, the nominal thickness may be less than 30 mm, e.g., less than 25 mm, less than 20 mm, or less than 15 mm. In terms of lower limits, the nominal thickness may be greater than 0.5 mm, e.g., greater than 1 mm, greater than 2 mm, or greater than 5 mm.

Figure 5:
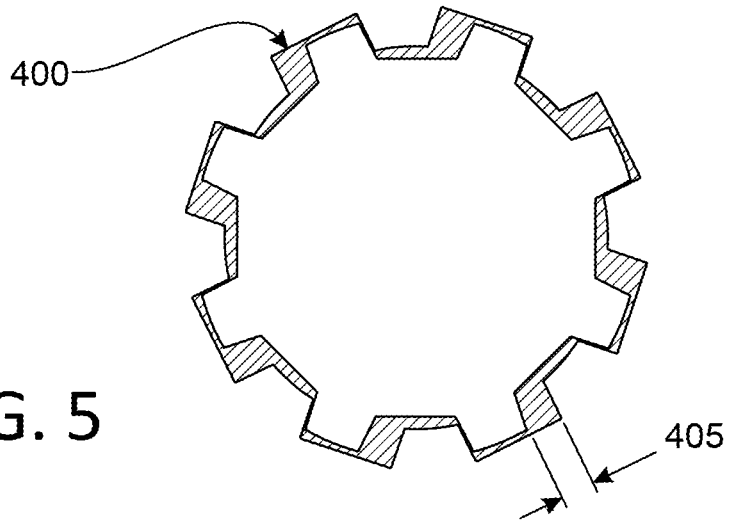
FIG. 5 is an upper isometric view of an intermediate component of the drill coupler from FIG. 1.

In some embodiments, the nominal thickness of the intermediate component varies. For example, the nominal thickness of the intermediate component may periodically increase or decrease about the circumference of the intermediate components. In some cases, the intermediate component may be thicker relative the counter-clockwise rotation. An exemplary intermediate component having a varying nominal thickness is illustrated in FIG. 5. As shown, the nominal thickness varies periodically. Furthermore, in the embodiment illustrated in FIG. 5, the intermediate component is prepared such that the base rotates against the thickest portion during drilling.

In embodiments of the drill coupler wherein the nominal thickness of the intermediate components varies, the thickness may be measured at its thickest point. Said another way, the intermediate component may be described by a maximum nominal thickness. In one embodiment, for example, the maximum nominal thickness is from 0.5 mm to 30 mm, e.g., from 1 mm to 25 mm, from 2 mm to 20 mm, or from 5 mm to 15 mm. In terms of upper limits, the maximum nominal thickness may be less than 30 mm, e.g., less than 25 mm, less than 20 mm, or less than 15 mm. In terms of lower limits, the maximum nominal thickness may be greater than 0.5 mm, e.g., greater than 1 mm, greater than 2 mm, or greater than 5 mm.

In some embodiments, the elongate cylinder of the base fits substantially inside the housing. A locking ring may be secured to an end of the elongate cylinder opposite to the flange, so that the locking ring prevents removal of the base from the housing. That is, the base flange prevents removal in one direction and the locking ring prevents removal in the other direction. In this way, the base and the housing are secured directly to one another, even though there is also an intermediate component in one portion.

In some example embodiments, the flange may have one or more through holes. The intermediate component can then be formed by injecting or pouring a settable compound through the one or more through holes. Otherwise stated, during manufacture the base and the housing may first be secured to one another, before the settable compound is then injected through the through holes to form the intermediate component.

In some embodiments, a drill bit assembly may be provided that includes a coupler as described with a drill bit secured to the base. For example, the drill bit may be directly welded to the base during manufacture, or secured in some other suitable way.

In some particular embodiments, the drill bit may be a polycrystalline diamond compact (PDC) bit. Such a drill bit is well known for use in oil and gas well drilling, where the composition of the ground being drilled is relatively consistent. This design of drill bit is known to be quite efficient for such situations, but is typically not considered suitable for situations where the ground is less consistent, such as in drilling in areas where faults, volcanic intrusions, and other inconsistencies can result in damage to the bit. However, the coupler is advantageous as it may provide sufficient dampening to allow this type of bit to be used in such situations, without excessive damage occurring to the bit or other components.

An example embodiment of a method of manufacturing or assembling a coupler for connecting a drill bit to a drill pipe will now be described. The coupler may be similar to that described previously, in that it includes a housing, a base, and an intermediate component disposed between. The method of manufacturing such a coupler may involve forming the housing and the base before inserting the base at least partially into the housing and securing to one another. The intermediate component can then be formed by injecting or pouring a settable compound into a space between the housing and the base.

Once the settable compound is allowed to harden, the coupler is then complete and has the advantage that the intermediate component will be shaped to very closely follow the form of the base and the housing. As such, any tolerances in the manufacture of the base and the intermediate component will not cause issues when assembling the coupler.

It will be appreciated that in an alternative embodiment a different method of manufacturing the coupler may be used. In such an example, the coupler may still be similar to that described previously, in that it includes a housing, a base, and an intermediate component disposed between. The method of manufacturing such a coupler may involve forming the housing, the base, and the intermediate component, and inserting the base at least partially into the housing with the intermediate component disposed between. The base and the housing can then be secured to one another.

An example embodiment of a method of blast hole drilling will now be described. In this method, a drill bit is secured to a drill pipe using a coupler. Advantageously, the coupler may be similar to that described previously. The assembled drill bit, coupler, and drill pipe can then be used with a drill rig to drill a blast hole.

In one particular example embodiment, the drill bit is a polycrystalline diamond compact (PDC) bit. As described previously, such a bit is typically not suitable for blast hole drilling due to the quality of the ground, particularly if blasting has already occurred previously, is too inconsistent and will generally result in the bit being damaged. As the bits are very expensive, it is not cost effective to replace or even repair the bits as frequently as would be required in these situations. However, by performing this method using the coupler as described, this may allow the bit to perform longer and therefore make use of such a bit in these conditions viable.

Several exemplary embodiments of the coupler of the present disclosure will now be described with reference to the Figures.

Figure 2:
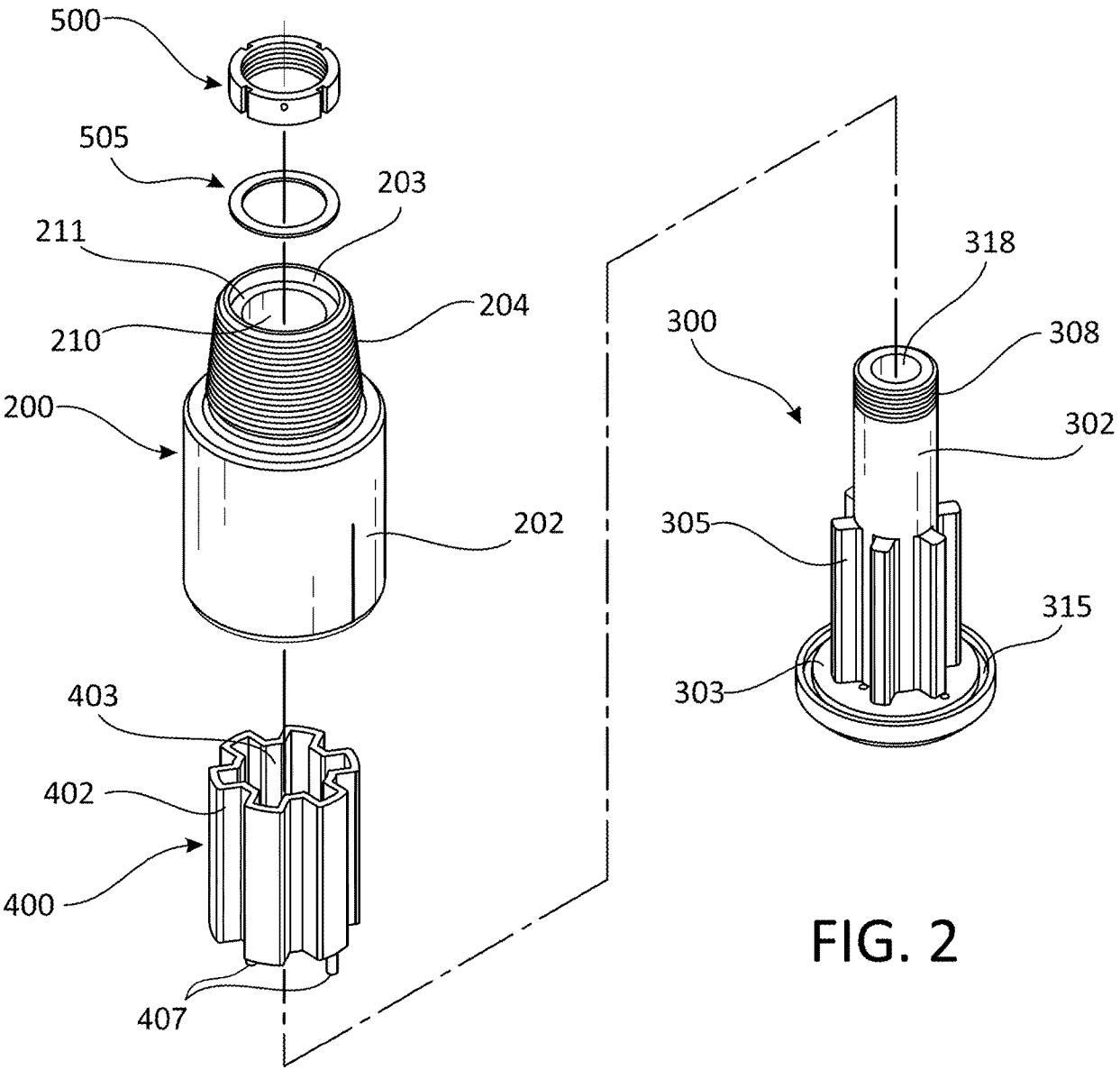
FIG. 2 is an exploded isometric view of the drill coupler from FIG. 1.

Reference is made initially to the one embodiment of the coupler as shown in FIGS. 1-5, particularly FIG. 2, which show most clearly shows the internal components of the assembled coupler 100. The coupler 100 includes a housing 200, a base 300, and an intermediate component 400.

Figure 3:
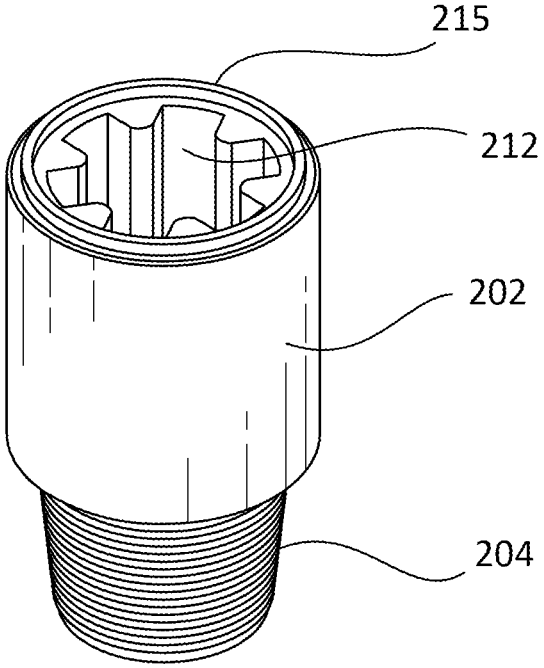
FIG. 3 is a lower isometric view of a housing of the drill coupler from FIG. 1.

FIGS. 2 and 3 show the housing 200 of this embodiment in more detail. In the illustrated embodiment, the housing 200 has a cylindrical body 202 with a connecting portion 203 at an upper end. The connecting portion 203 is configured to be connected to a drill string component (e.g., drill pipe) and has a conical thread 204 on an outer surface.

The housing 200 has a hollow core 210 that widens at the end near the connecting portion 203 to form a step 211. At the opposite end, the hollow core 210 includes a series of grooves 212 that give the hollow core 210 of this embodiment a cross sectional shape similar to a star or asterisk.

Figure 4:
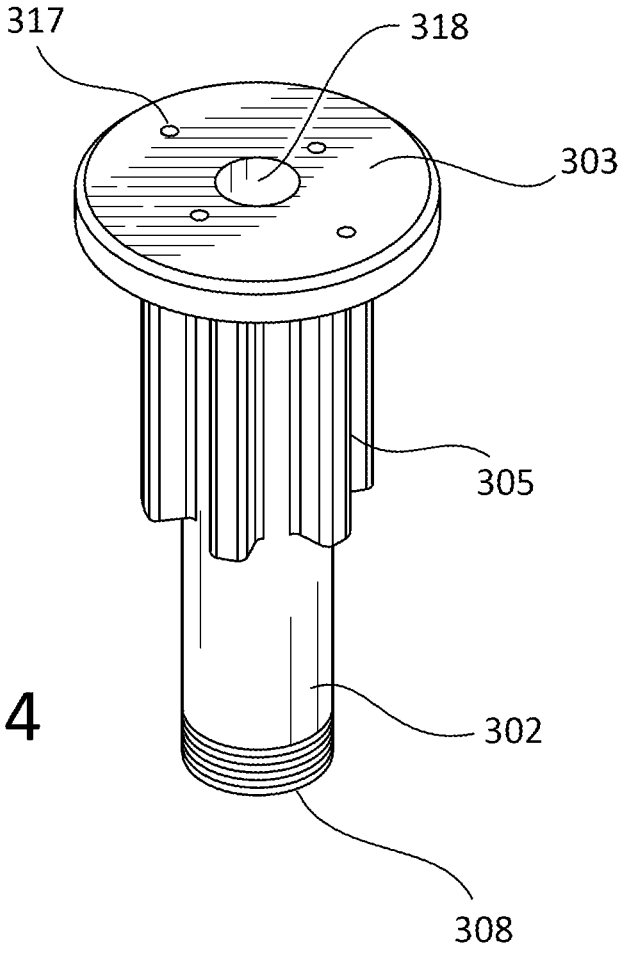
FIG. 4 is a lower isometric view of a base of the drill coupler from FIG. 1.
Figure 6:
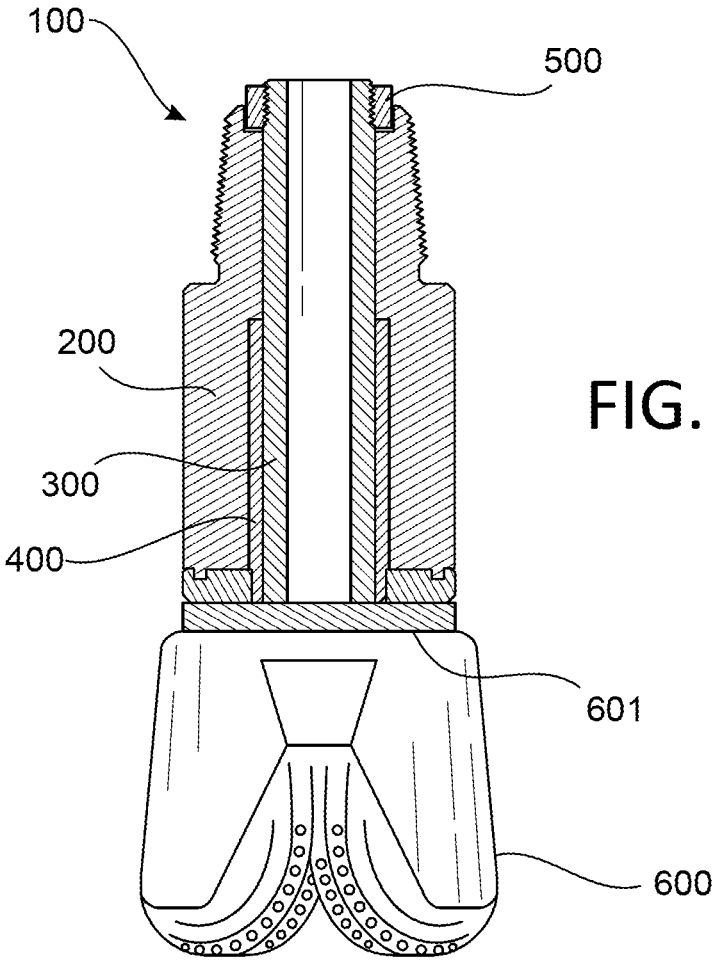
FIG. 6 is a cross-sectional front view of the drill coupler from FIG. 1, shown connected to a drill bit.

FIGS. 2 and 4 show the base 300 of this embodiment in more detail. In the illustrated embodiment, the base 300 has an elongate cylinder 302 with a flange 303 extending from a lower end normal to a longitudinal axis of the cylinder 302. The flange 303 may be configured for attachment to a drill string component 600 (e.g., a drill bit), such as by welding 601 as shown in FIG. 6. It will be appreciated that the drill bit shown in FIG. 6 is for illustration purposes only and that the drill string component 600 may be any other component fitted in this way.

A series of splines 305 extend radially from an outer surface of the cylinder 302. The splines 305 give this portion of the base 300 a cross sectional appearance generally similar to that of the housing 200 in the region of the grooves 212, only smaller. This allows the base 300 and the housing 200 to be fitted to one another, as will be described below. The end of the cylinder 302 opposite to the flange 303 includes a thread 308, which is also used for coupling the base 300 to the housing 200 and will also be described below.

FIGS. 2 and 5 show the intermediate component 400 of this embodiment in more detail. In the illustrated embodiment, the intermediate component 400 has an outer surface 402 that substantially matches the shape of the hollow core 210 and grooves 212 of the housing 200. It also has an inner surface 403 that substantially matches the cylinder 302 and splines 305 of the base 300. In this way, the intermediate component 400 is a sleeve that fits over the base 300 and within the housing 200, filling a space between the splines 305 of the base 300 and the grooves 212 of the housing 200.

As described previously, the intermediate component 400 can be disposed between the base 300 and the housing 200 when the coupler 100 is assembled. In the embodiment shown in FIG. 5, the intermediate component 400 has a varying thickness, with a maximum nominal thickness 405 in this embodiment of about 10 mm. Of course, it will be appreciated that this may vary in alternative embodiments.

When the coupler 100 of this embodiment is assembled, the base 300 is inserted into the housing 200 so that the flange 303 abuts a lower end of the housing 200. In this embodiment, a rib 215 is provided on this lower end of the housing 200 that fits within a slot 315 in the flange 303 of the base 300 for alignment.

The base 300 is secured in place within the housing 200 using a locking ring 500 with an internal thread 501 that is fitted onto the thread 308 of the base 300. The locking ring 500 can be threaded onto the base 300 until it abuts the step 211 at the upper end of the housing 200. In this way the base 300 is secured within the housing 200 as the locking ring 500 prevents the removal.

In some cases, slots can be used to tighten the locking ring 500 in place. In some cases, the locking ring may include, for example, a hole for a set screw to prevent the locking ring 500 from coming loose over time. Other tools may be used to secure the locking ring, such as ball bearings and locking pins. Locking the components together advantageously prevents removal of the base 300 from the housing 200 while still allowing some level of relative rotation between these components. In the illustrated embodiment, a washer 505 is disposed between the locking ring 500 and the step 211 of the housing 200 to reduce friction and/or to prevent wear from relative rotation.

During use of the coupler 100, it is rotated about the longitudinal axis of the cylinder 302, which will be aligned with the drill pipe and the intended rotation axis of the drill bit. In the event that an unusually high rotational force is applied between the drill pipe and the drill bit, the intermediate component 400 can deform, allowing limited relative rotation between the housing 200 and the base 300 about the axis.

Despite this relative rotation being possible, as the splines 305 are partially within the grooves 212 there is a limit to the degree of relative rotation that can occur. In the present embodiment this is about 4-6° from a neutral position, but it will be appreciated that this may vary in alternative embodiments.

For the intermediate component 400 to allow this relative rotation to occur, it will be made from a material that is resiliently deformable, so that it will substantially return to its original shape once the force is removed. In the embodiment being described this will be a plastic, but it will be appreciated that many other materials could alternatively be used.

To form the intermediate component 400, the base 300 can first be inserted and secured to the housing 200. A settable compound can then be injected via through holes 317 into the space between the base 300 and the housing 200. The compound can completely fill this space and then be allowed to set, thereby forming the intermediate component 400. As a result, excess material that remains in the through holes 317 forms the spikes 407 that can be seen extending from the end of the intermediate component 400.

While the present embodiment involves forming the intermediate component 400 by injecting or pouring as just described, it will be appreciated that it may also be possible in other embodiments to form the intermediate component separately before then assembling with the base 300 and the housing 200.

The base 300 has a central bore 318 that extends through the length of the cylinder 302 and through the flange 303. As the base 300 extends completely through the housing 200 when the coupler 100 is assembled, this means that the central bore 318 effectively extends through the full length of the coupler 100. As such, this bore 318 allows for fluid communication between the drill pipe and the drill bit 600 through the coupler. Therefore, drilling fluid such as air or drilling mud as may be required can still be supplied to the drill bit 600.

As has been noted, the coupler described herein may vary. In particular, the drill string components that are connected, as well as the means of connecting the coupler to each drill string component, may vary in various embodiments. To further illustrate this, reference is made to additional embodiments shown in FIGS. 7 and 8.

Figure 7:
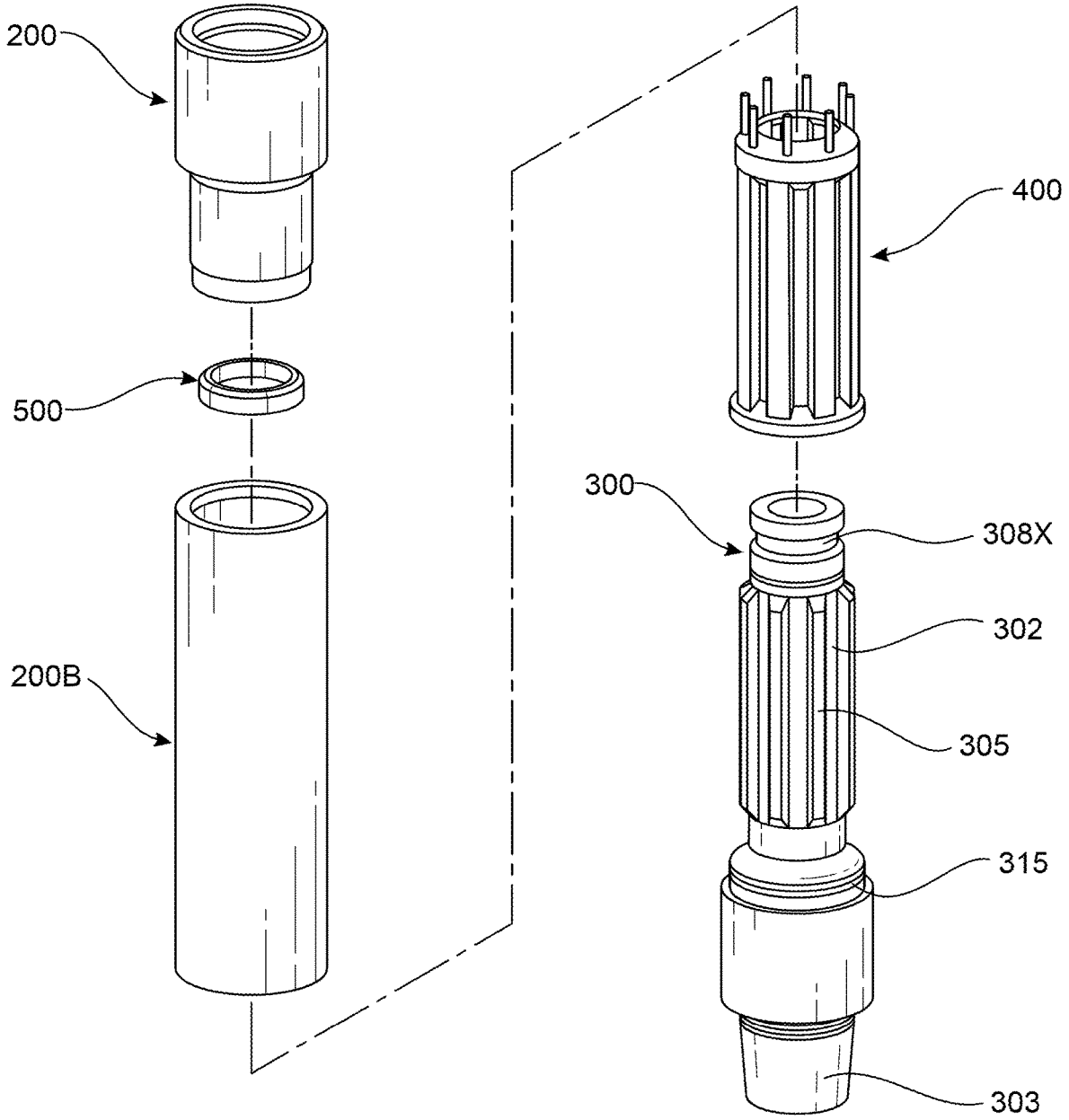
FIG. 7 is an exploded isometric view of a drill coupler according to an embodiment of the present disclosure

FIG. 7 illustrates another embodiment of the coupler including a housing 200 (which includes a non-contiguous subcomponent cylinder 200B), a base 300, and an intermediate component 400. As with the embodiment illustrated FIGS. 1-6, the base of this embodiment includes base 300 has an elongate cylinder 302 with a flange 303 extending from a lower end normal to a longitudinal axis of the cylinder 302. A series of splines 305 extend radially from an outer surface of the cylinder 302. The end of the cylinder 302 opposite to the flange 303 includes a slot 308X, which is also used for coupling the base 300 to the housing 200. The coupler also includes a locking ring 500 for attaching the base 300 to the housing 200.

In the embodiment of FIG. 7, the housing 200 has a connecting portion at an upper end, and the connecting portion may be configured to be connected to a drill string component by a conical thread on an inner surface (not shown). The base 300, meanwhile, may be configured to be connected to a drill string component by a conical thread on an outer surface.

Figure 8:
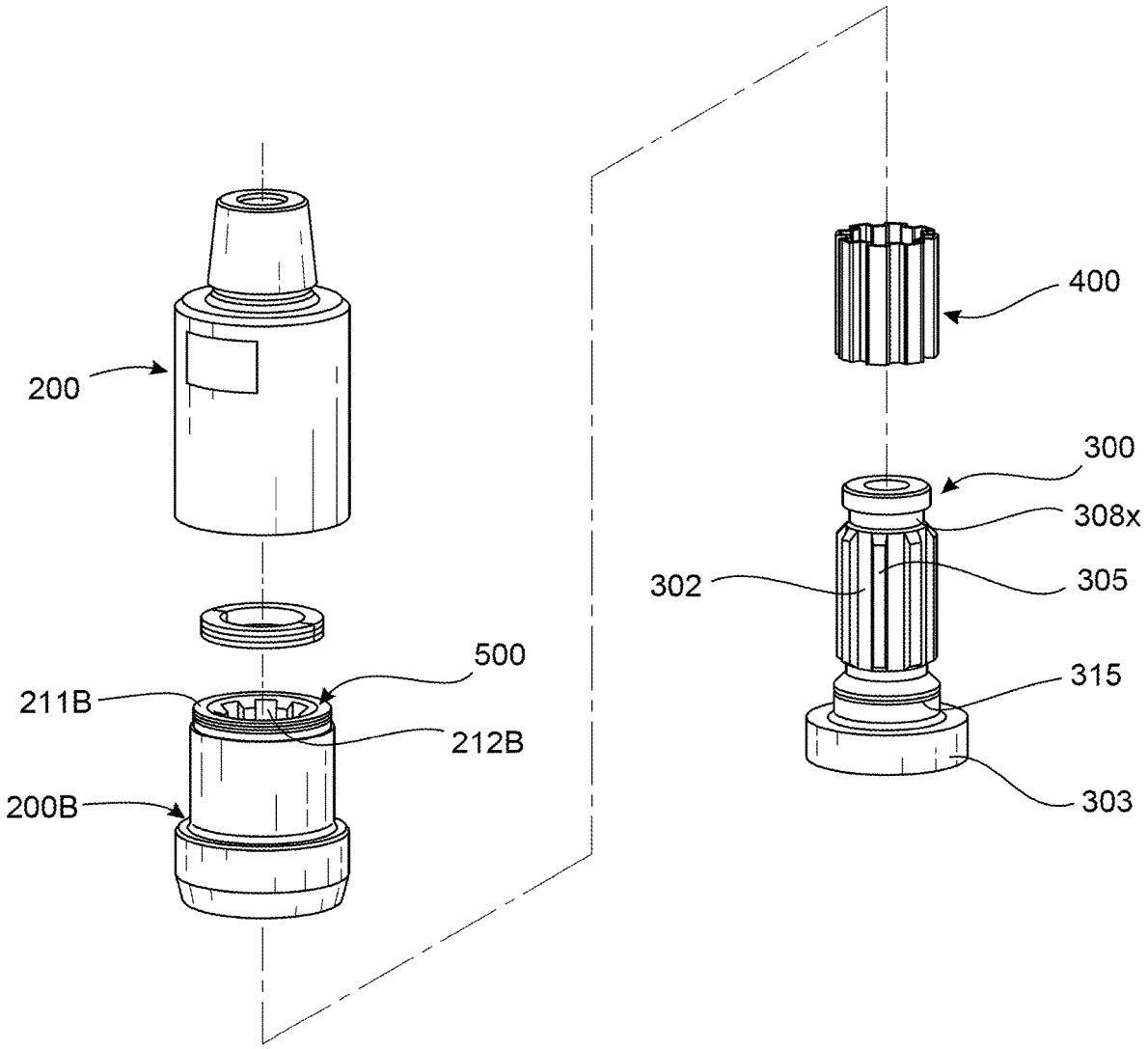
FIG. 8 is an exploded isometric view of a drill coupler according to an embodiment of the present disclosure

FIG. 8 illustrates still another embodiment of the coupler including a housing 200 (which includes a non-contiguous subcomponent cylinder 200B), a base 300, and an intermediate component 400. As with the embodiment illustrated FIGS. 1-6, the base of this embodiment includes base 300 has an elongate cylinder 302 with a flange 303 extending from a lower end normal to a longitudinal axis of the cylinder 302. A series of splines 305 extend radially from an outer surface of the cylinder 302. The end of the cylinder 302 opposite to the flange 303 includes a slot 308X, which is also used for coupling the base 300 to the housing 200. The subcomponent cylinder 200B has a hollow core that widens to form a step 211B and that includes a series of grooves 212B. The coupler of this embodiment also includes a locking ring 500 for attaching the base 300 to the housing 200.

In the embodiment of Figure B, the housing 200 has a connecting portion at an upper end, and the connecting portion may be configured to be connected to a drill string component by welding or a conical thread (not shown). The base 300, meanwhile, may be configured to be connected to a drill string component by welding.

In the foregoing description of preferred embodiments, specific terminology has been resorted to for the sake of clarity. However, the disclosure is not intended to be limited to the specific terms so selected, and it is to be understood that each specific term includes all technical equivalents which operate in a similar manner to accomplish a similar technical purpose.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

Persons skilled in the art will appreciate that numerous variations and modifications will become apparent. All such variations and modifications which become apparent to persons skilled in the art, should be considered to fall within the spirit and scope that the disclosure broadly appearing before described.

EMBODIMENTS

As used below, any reference to a series of embodiments is to be understood as a reference to each of those embodiments disjunctively (e.g., "Embodiments 1-4" is to be understood as "Embodiments 1, 2, 3, or 4").

Embodiment 1 is a coupler for connecting a first drill string component to a second drill string component, the coupler comprising: a housing comprising a first connecting portion at a first end for connecting to a first drill string component; a base coupled to the housing and comprising a second connecting portion at a second end for connecting to a second drill string component; and an intermediate component disposed between the base and the housing; wherein the coupler is configured for rotation about an axis during use, and wherein the intermediate component is configured for allowing limited relative rotation between the housing and the base about the axis.

Embodiment 2 is the coupler of embodiment(s) 1, wherein the first drill string component is selected from the group consisting of a drill bit, a drill collar, a drill pipe segment, a stabilizer, a mud motor, a component of a mud motor assembly, and a bottom hole assembly.

Embodiment 3 is the coupler of embodiment(s) 1-2, wherein the second drill string component is selected from the group consisting of a drill bit, a drill collar, a drill pipe segment, a stabilizer, a mud motor, a component of a mud motor assembly, and a bottom hole assembly.

Embodiment 4 is the coupler of embodiment(s) 1-3, wherein the first drill string component comprises a mud motor, a drill collar, rotatory steerable tool, or a metal tubular component, and wherein the second drill string component comprises a drill bit.

Embodiment 5 is the coupler of embodiment(s) 1-4, wherein the intermediate component is made from a resiliently deformable material.

Embodiment 6 is the coupler of embodiment(s) 1-5, wherein the first drill string is connected to the housing by a thread or by welding, or wherein the first drill string component is contiguous with the housing.

Embodiment 7 is the coupler of embodiment(s) 1-6, wherein the second drill string component is connected to the base by a thread or by welding, or wherein the second drill string component is contiguous with the base.

Embodiment 8 is the coupler of embodiment(s) 1-7, wherein the coupler comprises a central bore for fluid communication between the first drill string component and the second drill string component through the coupler.

Embodiment 9 is the coupler of embodiment(s) 1-8, wherein the relative rotation between the housing and the base is limited to less than 30° from a nominal position.

Embodiment 10 is the coupler of embodiment(s) 1-9, wherein the intermediate component has a maximum nominal thickness of less than 30 mm.

Embodiment 11 is the coupler of embodiment(s) 1-10, wherein the base is situated at least partially inside the housing and the intermediate component is a sleeve that fits between the base and the housing and is substantially inside the housing.

Embodiment 12 is the coupler of embodiment(s) 1-11, wherein the base comprises: an elongate cylinder with a flange extending from a lower end normal to the axis, the flange being configured for attachment to the second drill string component; and a plurality of splines extending radially from an outer surface of the elongate cylinder.

Embodiment 13 is the coupler of embodiment(s) 12, wherein the housing comprises a cylindrical body with a plurality of grooves on an inner surface configured to accommodate the splines of the base.

Embodiment 14 is the coupler of embodiment(s) 13, wherein the intermediate component is a sleeve that fills a space between the splines of the base and the grooves of the housing.

Embodiment 15 is the coupler of embodiment(s) 12-14, wherein the elongate cylinder of the base fits substantially inside the housing and a locking ring is secured to an end of the elongate cylinder opposite to the flange, such that the locking ring prevents removal of the base from the housing.

Embodiment 16 is the coupler of embodiment(s) 12-15, wherein the flange comprises one or more through holes and the intermediate component is formed by injecting or pouring a settable compound through the one or more through holes.

Embodiment 17 is a method of manufacturing a coupler for connecting a first drill string component to a second drill string component, the coupler comprising a housing, a base, and an intermediate component disposed between, the method comprising the steps of: forming the housing and the base; inserting the base at least partially into the housing and securing to one another; and forming the intermediate component by injecting or pouring a settable compound into a space between the housing and the base.

Embodiment 18 is a method of manufacturing a coupler for connecting a first drill string component to a second drill string component, the coupler comprising a housing, a base, and an intermediate component disposed between, the method comprising the steps of: forming the housing, the base, and the intermediate component; inserting the base at least partially into the housing with the intermediate component disposed between; and securing the base and the housing to one another.

Embodiment 19 is a method of drilling, the method comprising the steps of: securing a drill bit to a drill string component using a coupler according to claim 1 to form an assembled drill; and using the assembled drill string with a drill rig to drill.

Embodiment 20 is the method of drilling of embodiment (s) 19, wherein the drill bit is a polycrystalline diamond compact (PDC) bit or a claw bit.

What is claimed is:

1. A coupler for connecting a first drill string component to a second drill string component, the coupler comprising:

a housing comprising a first threaded connecting portion at a first end for connecting to a first drill string component;

a base coupled to the housing and comprising a second threaded connecting portion at a second end for connecting to a second drill string component, wherein the first end and the second end are at opposite ends of the coupler;

an intermediate component disposed between the base and the housing, wherein the intermediate component is made from a resiliently deformable material; and a locking ring that is removably coupled with the base and that couples the base to the housing to constrain axial movement between the base and the housing, wherein:

the locking ring has a maximum outer diameter that is smaller than a maximum outer diameter of the housing and a maximum outer diameter of the base; and the coupler is configured for rotation about a longitudinal axis of the coupler during use, and wherein the intermediate component is configured for allowing limited relative rotation between the housing and the base about the longitudinal axis, and wherein the intermediate component deforms as the housing and the base rotate relative to one another about the longitudinal axis and returns to an original shape as the housing and the base return to their respective original positions.

2. The coupler of claim 1, wherein the first drill string component is selected from the group consisting of a drill bit, a drill collar, a drill pipe segment, a stabilizer, a mud motor, a component of a mud motor assembly, and a bottom hole assembly.

3. The coupler of claim 1, wherein the second drill string component is selected from the group consisting of a drill bit, a drill collar, a drill pipe segment, a stabilizer, a mud motor, a component of a mud motor assembly, and a bottom hole assembly.

4. The coupler of claim 1, wherein the first drill string component comprises a mud motor, a drill collar, rotatory steerable tool, or a metal tubular component, and wherein the second drill string component comprises a drill bit.

5. The coupler of claim 1, wherein the coupler comprises a central bore for fluid communication between the first drill string component and the second drill string component through the coupler.

6. The coupler of claim 1, wherein the relative rotation between the housing and the base is limited to less than 30° from a nominal position.

7. The coupler of claim 1, wherein the intermediate component has a maximum nominal thickness of less than 30 mm.

8. The coupler of claim 1, wherein the base is situated at least partially inside the housing and the intermediate component is a sleeve that fits between the base and the housing and is substantially inside the housing.

9. The coupler of claim 1, wherein the base comprises:

an elongate cylinder with a flange extending from a lower end normal to the axis, the flange being configured for attachment to the second drill string component; and a plurality of splines extending radially from an outer surface of the elongate cylinder.

10. The coupler of claim 9, wherein the housing comprises a cylindrical body with a plurality of grooves on an inner surface configured to accommodate the splines of the base.

11. The coupler of claim 10, wherein the intermediate component is a sleeve that fills a space between the splines of the base and the grooves of the housing.

12. The coupler of claim 9, wherein the elongate cylinder of the base fits substantially inside the housing and the locking ring is secured to an end of the elongate cylinder opposite to the flange, such that the locking ring prevents removal of the base from the housing.

13. The coupler of claim 9, wherein the flange comprises one or more through holes and the intermediate component is formed by injecting or pouring a settable compound through the one or more through holes.

14. The coupler of claim 1, wherein one or both of the first threaded connecting portion and the second threaded connecting portion comprises a female connector.

15. The coupler of claim 1, wherein the locking ring is coaxial with a longitudinal axis of the base.

16. The coupler of claim 1, wherein the intermediate component is thicker in a direction of counter-clockwise rotation than in a direction of clockwise rotation.

17. The coupler of claim 1, wherein the intermediate component is a single component.

18. The coupler of claim 1, wherein the outer diameter of the locking ring is positioned to be fully covered when the coupler is coupled with the first drill string component and the second drill string component.

19. A method of drilling, the method comprising the steps of:

securing a drill bit to a drill string component using a coupler according to claim 1 to form an assembled drill; and using the assembled drill string with a drill rig to drill.

20. The method of drilling of claim 19, wherein the drill bit is a polycrystalline diamond compact (PDC) bit or a claw bit.

21. A method of manufacturing a coupler for connecting a first drill string component to a second drill string component, the coupler comprising a housing, a base, and an intermediate component disposed between, the method comprising the steps of:

forming the housing and the base, wherein:

the housing comprises a first threaded connecting portion at a first end for connecting to a first drill string component;

the base comprises a second threaded connecting portion at a second end for connecting to a second drill string component; and the first end and the second end are at opposite ends of the coupler;

inserting the base at least partially into the housing and securing to one another; and forming the intermediate component by injecting or pouring a settable compound into a space between the housing and the base, wherein:

the intermediate component is made from a resiliently deformable material, wherein the coupler is configured for rotation about a longitudinal axis of the coupler during use;

the intermediate component is configured for allowing limited relative rotation between the housing and the base about the longitudinal axis;

the intermediate component deforms as the housing and the base rotate relative to one another about the longitudinal axis and returns to an original shape as the housing and the base return to their respective original positions;

the base and the housing are secured to one another using a locking ring that is removably coupled with the base and that constrains axial movement between the base and the housing; and the locking ring has a maximum outer diameter that is smaller than a maximum outer diameter of the housing and a maximum outer diameter of the base.

22. A method of manufacturing a coupler for connecting a first drill string component to a second drill string component, the coupler comprising a housing, a base, and an intermediate component disposed between, the method comprising the steps of:

forming the housing, the base, and the intermediate component, wherein:

the housing comprises a first threaded connecting portion at a first end for connecting to a first drill string component; and the base comprises a second threaded connecting portion at a second end for connecting to a second drill string component;

inserting the base at least partially into the housing with the intermediate component disposed between, wherein the intermediate component is made from a resiliently deformable material; and securing the base and the housing to one another using a locking ring that is removably coupled with the base and that constrains axial movement between the base and the housing and such that the first end and the second end are at opposite sides of the coupler, wherein:

the locking ring has a maximum outer diameter that is smaller than a maximum outer diameter of the housing and a maximum outer diameter of the base;

the coupler is configured for rotation about a longitudinal axis of the coupler during use;

the intermediate component is configured for allowing limited relative rotation between the housing and the base about the longitudinal axis; and the intermediate component deforms as the housing and the base rotate relative to one another about the longitudinal axis and returns to an original shape as the housing and the base return to their respective original positions.

* * * * *